United States Patent [19]

Barthel

[11] 4,140,346

[45] Feb. 20, 1979

[54] CAVITY MINING MINERALS FROM SUBSURFACE DEPOSIT

[75] Inventor: Ronald Barthel, Rijswijk, Netherlands

[73] Assignee: Shell Oil Company, Houston, Tex.

[21] Appl. No.: 796,506

[22] Filed: May 12, 1977

[30] Foreign Application Priority Data

Jun. 28, 1976 [GB] United Kingdom ..... 26804/76

[51] Int. Cl.[2] ..... E21B 43/28

[52] U.S. Cl. ..... 299/17; 299/5; 175/67

[58] Field of Search ..... 299/4, 5, 17, 18; 175/67, 213; 302/51, 56, 57; 241/270, 271

[56] References Cited

U.S. PATENT DOCUMENTS

| | | | |
|---|---|---|---|
| 249,995 | 11/1881 | Richards | 241/271 X |
| 1,612,611 | 12/1926 | Claytor | 299/17 X |
| 2,720,381 | 10/1955 | Quick | 175/67 X |
| 3,093,325 | 6/1963 | Bambi | 241/270 X |
| 3,472,553 | 10/1969 | Miller | 299/5 |
| 3,652,129 | 3/1972 | Edmonds | 299/4 |
| 3,823,981 | 7/1974 | Lewis | 299/4 |
| 3,880,470 | 4/1975 | Davis | 299/17 |
| 3,951,457 | 4/1976 | Redford | 299/17 X |

*Primary Examiner*—Ernest R. Purser
*Assistant Examiner*—Nick A. Nichols, Jr.

[57] ABSTRACT

Cavity mining minerals from a subsurface deposit by hydraulically jetting and disintegrating a mineral deposit locally, and transporting lumps and particles to the surface via a borehole.

12 Claims, 3 Drawing Figures

CAVITY MINING MINERALS FROM SUBSURFACE DEPOSIT

BACKGROUND OF THE INVENTION

1. Field of the Invention

The invention relates to a method and means for cavity mining materials from a subsurface deposit.

2. Prior Art

The most common techniques for removing coal from the ground are by strip mining, in which the coal is dug out of the ground by hydraulic or mechanical means, and underground mining, in which slurry mining (U.S. Pat. No. 3,260,548), room and pillar, or longwall techniques are employed. In slurry mining, hydraulic apparatus is used to direct pressurized water at the coal seam to disaggregate the coal and form a slurry which is then pumped out of the mine. The present invention provides an improvement in this type of coal mining.

SUMMARY OF THE INVENTION

The present invention relates to a technique for cavity mining by hydraulically jetting the deposit locally. Thereby those parts of the deposit that are hit by water jets are disintegrated and lumps and particles are dislodged from the deposit, which lumps and particles are transported to the surface via a borehole. In this manner an underground cavity is formed in which the jets are being operated. The jet liquid is normally water, which is supplied to a single jet nozzle (or a plurality of jet nozzles) in the cavity via a tubing situated in a borehole, which may be the borehole via which the lumps and particles are transported upwards. The lumps and particles that are to be transported to the surface are mixed with the jet liquid to form a slurry and pumped (such as by means of a hydraulic jet pump) upwards through the borehole.

The pumping means is situated in a small-diameter sump that communicates by the upper end thereof with the lower part of the cavity.

The jet nozzles are mounted on a tube that can be rotated and moved up and down in the cavity, whereby the jets issuing from the nozzles hit the sidewall of the cavity to disintegrate the wall portions and break particles and lumps therefrom. The lumps should be sufficiently small to pass through the pumping means, but it has been found that under certain conditions relatively large lumps will be broken from the cavity wall, which lumps will tend to clog the passage leading to the pumping means.

A principal purpose of the invention is a method and means whereby such clogging will be prevented, thus allowing an uninterrupted operation of the pumping means over long periods.

The method according to the invention includes the steps of crushing lumps at or near the entrance of the pumping means.

The means according to the invention includes a crusher for crushing lumps at or near the entrance of the pumping means.

DESCRIPTION OF PREFERRED EMBODIMENTS

Figure 1:
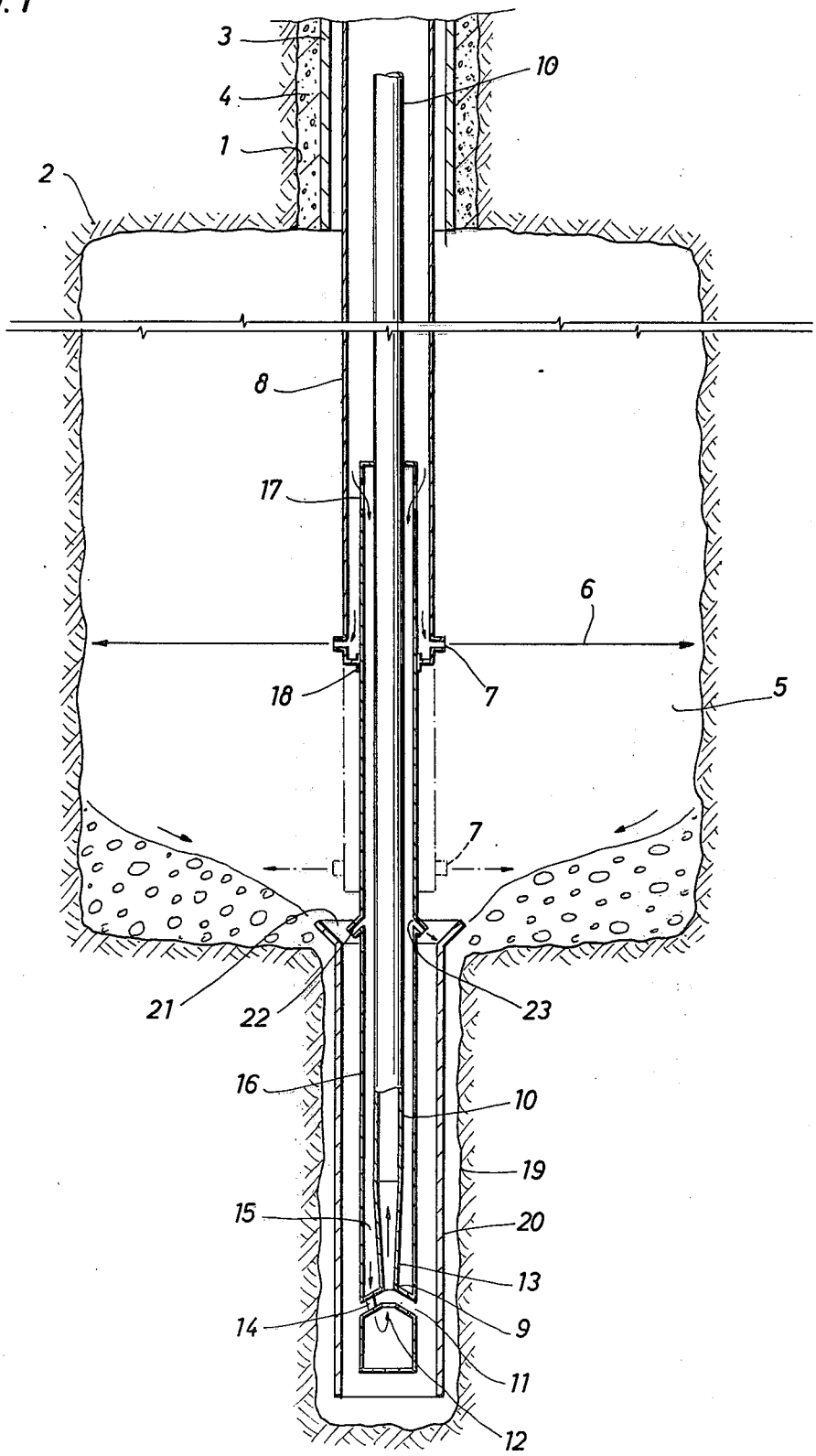
FIG. 1 shows schematically a longitudinal section over a cavity with mining equipment, the latter including a crushing means operating according to the jet principle.

FIG. 1 shows a borehole 1 drilled in a subsurface formation 2 comprising minerals that are to be recovered by a cavity mining operation. The wall of the borehole is supported against caving in by a casing 3 cemented to the wall of the borehole 1 by means of a cement layer 4. A cavity 5 has been formed by means of the action of waterjets 6 issuing from the nozzles 7 mounted on the lower end of the tubing 8. Tubing 8 is supported at its upper end at the wellhead (not shown) and communicates with high pressure pumps for supplying the water necessary for creating the jets 6, as well as for creating a lifting force in the waterjet pump 9. This pump is supported at the lower end of the tubing 10, and communicates at the pump outlet thereof with the lower end of the tubing 10. The pump inlet openings 11 are situated between the jet nozzle 12 and the mixing chamber 13. Short pipes 14 (only one being shown in the drawing) form a communication between the jet nozzle 12 and the annular space 15 situated between the lower end of the tubing 10 (including the mixing chamber 13) and the tubing 16, which tubing 16 is at the upper end thereof connected to the tubing 10. Openings 17 allow communication between the interior of the tubing 8 and the said annular space 15, thereby allowing water to flow from the tubing 8 to the nozzle 12 of the pump 9 for lifting mineral particles that are being supplied to the pump inlet opening 11. The lower end of the tubing 8 is provided with a seal 18 that can slide over the outer wall of the upper end of the pipe 16. Thus, while the tube 10 and consequently also the pump 9 remain immobile in the formation 2, the tubing 8 can be moved up and down as well as be rotated to allow the jets 6 to attack the various parts of the surface of the cavity wall, thereby breaking particles and lumps therefrom, which particles and lumps together with the water from the jet gravitate downwards towards the sump 19 in which the pump 9 is situated. It is observed that the wall of the sump 19 is protected against caving in by casing 20. This casing 20 may be cemented in the sump 19 or be connected thereto in any other manner suitable for the purpose. The particles and lumps that are broken out of this wall of the cavity 5, are collected on the bottom of the cavity and transported from thereon by gravity to the sump 19, thereby passing through the entrance 21 to the casing 20, in which entrance the large lumps are cut down to a smaller size by means of the operatively positioned jets 22 that originate from the nozzles 23 mounted in the wall of the tubing 16. Thus, those lumps too large to pass through the casing 20, are disintegrated, and subsequently gravitate downwards to the entrance 11 of the pump 9.

It will be appreciated that the direction of the plurality of jets 22 may be changed by rotating the tubing 16. The tubing 16 may either be rotated continuously or intermittently.

Figure 2:
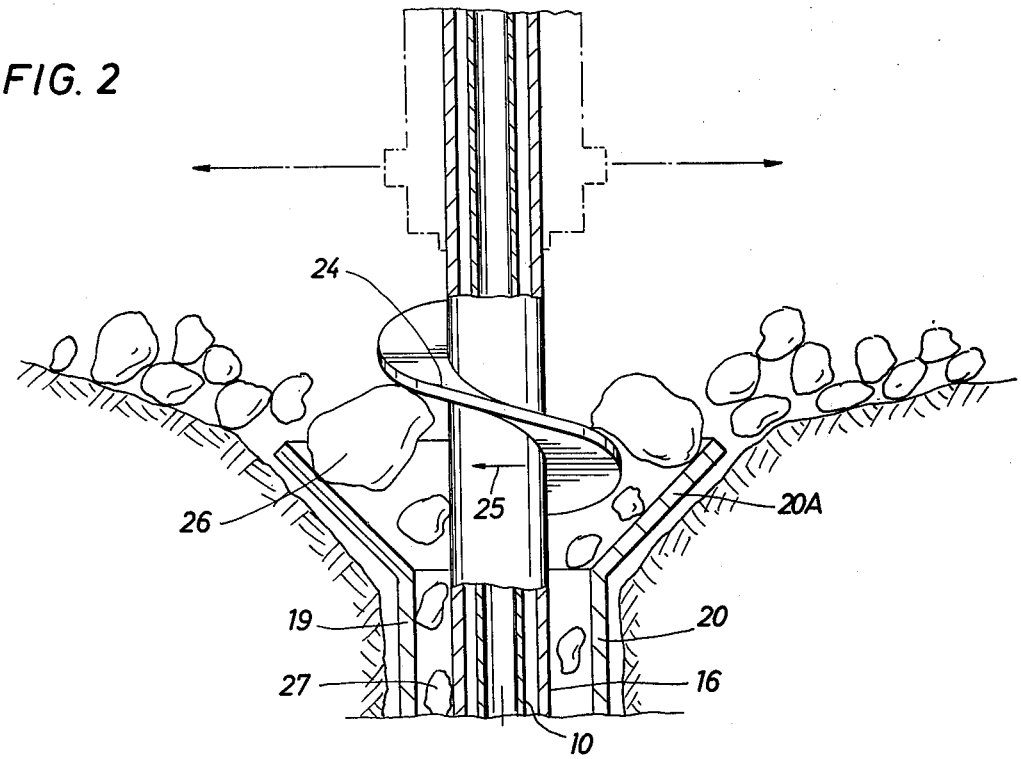
FIG. 2 shows schematically, partly in longitudinal section and partly in side view, a crushing means provided with a screw.

Instead of crushing the large lumps by jet action on entering the entrance to the casing 20, the desired crushing action may be carried out in an alternative manner by replacing the jet nozzles 23 by a screw-type crusher that is mounted on the tubing 16 at the level of the jet nozzles 23. FIG. 2 shows the arrangement of such a screw-type crusher 24, operatively at the entrance of the casing 20. The screw-type crusher 24 is an alternative of the hydraulic crusher of the installation shown in FIG. 1. The screw-type crusher 24 shown in FIG. 2 is mounted on the outer wall of the tubing 16 at the level of the entrance cone 20A of the casing 20. This entrance cone may be in one piece with the casing 20, or formed by parts that are hingedly connected to the top end of the cylindrical casing 20 to allow the assembly to enter through the borehole 1 when mounting the assembly in the sump 19.

By rotating the tubing 16 in the direction of arrow 25, large lumps like the lump 26 are caught between the screw 24 and the entrance cone 20A of the casing 20 and crushed, that is disintegrated to particles 27 of a size sufficiently small to allow the particles to enter the annulus between the casing 20 and the tubing 16.

The pitch of the screw 24 may be constant or vary along the length thereof.

Figure 3:
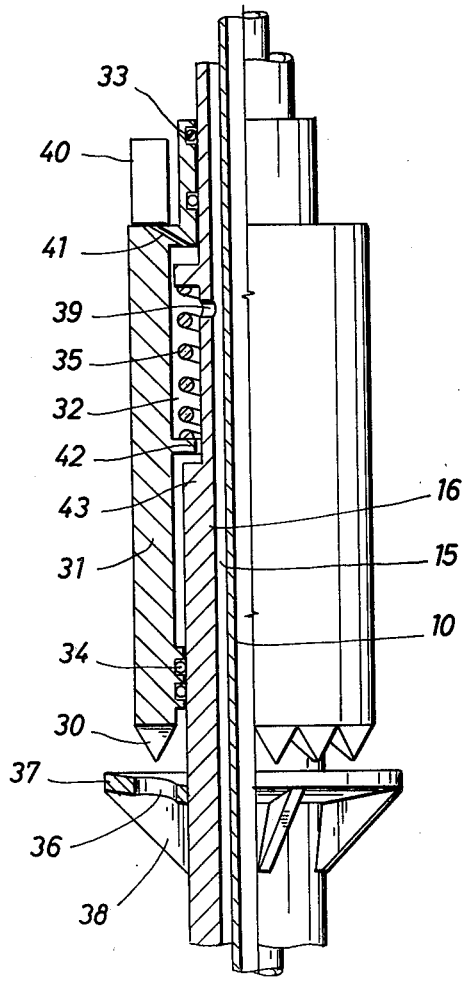
FIG. 3 shows schematically, partly in longitudinal section and partly in side view, a crushing means provided with coarse teeth.

In another alternative arrangement the screw crusher 24 of FIG. 2 is replaced by a crushing means with coarse teeth operatively positioned at the entrance cone 20A of the casing 20. The teeth 30 (see FIG. 3) are mounted on a housing 31 that is slideably arranged on the outer wall of the tubing 16. It will be appreciated that the crushing means shown in FIG. 3 is an alternative of the jet crushing means shown in FIG. 1. Corresponding parts in FIGS. 3 and 1 are therefore referred to with the same reference numbers.

An annular chamber 32 is enclosed between the housing 31 and the tubing 16, which chamber is closed off at the ends thereof by sealing means 33 and 34. The teeth 30 are pressed downwards by the spring 35. In the lower position of the teeth 30, each tooth cooperates with an opening 36 arranged in the circular plate 37 that is supported by the tubing 16 and reinforced by reinforcements 38.

The teeth 30 are lifted from the opening 36 by fluid under pressure that flows from the annular space 15 between the tubing 16 and the tubing 10 via the opening 39 arranged in the wall of the tubing 16. The passage through opening 39 is relatively narrow, and consequently the pressure inside the annular chamber 32 is slightly higher than the pressure in the space outside the housing 31. The housing 31 is displaced upwards against the action of the spring 35. When the spring 35 is fully compressed, the housing 31 becomes immobile and the pressure in the chamber 32 rises to a value equal to the pressure in the annulus 15. At that pressure, the valve 40 suddenly opens. This valve is arranged between the space outside the housing 31 and the chamber 32 (via the conduit 41). As a result of the opening of the valve 40, the pressure in the chamber 32 is suddenly released. The valve 40 stays open and the housing 31 is moved downwards by the action of the spring 35, whereupon the teeth 30 in cooperation with the openings 36 crush by impact any coarse lumps that may have been collected on the circular plate 37 and that are of such a size that they cannot pass through the openings 36.

Valve 40 is schematically indicated in the drawing. This valve is of a known type and does not require any detailed description. If desired, a plurality of such valves may be mounted on the housing 31.

It will be appreciated that by the action of the valve 40, the housing 31 and consequently also the teeth 30 are periodically displaced up and down. Independent thereof, the tubing 8 (see FIG. 1) may be displaced up and down and/or rotated by being actuated at the wellhead. By these displacements, the jets 6 are operated to distintegrate the surface of the wall of the cavity 5.

It will be appreciated that the invention is not restricted to hydraulically actuated impact crushing means of the type shown in FIG. 3.

Also, the invention is not limited to a ram-type crusher showing the teeth arrangement of FIG. 3. Any number and configuration of teeth may be applied, in combination with a circular plate 37 designed for cooperation with such teeth. If desired, a single annular tooth or crushing member may be applied.

Ring member 42 inside the housing 31 and the part 43 of the tubing 16 may act as stopmembers for controlling the degree of crushing during operation of rams of the type shown in FIG. 3. These members prevent the tooth or teeth from fully contacting the circular plate 37.

In an alternative embodiment (not shown), a ram-type crusher may be applied that can be lifted by cams mounted on the tubing 16, which cams are designed such that rotation of the tubing 16 lifts an annular heavy crushing ram to a desired level, thereafter releasing the ram which then drops down onto a crushing plate to disintegrate coarse lumps. The cams act as a ratchet system and the ram is periodically lifted after the crushing action. The ram is prevented from rotation in combination with the rotating cams by means of a fixed guide means, which means may be mounted on the casing 20 in the sump 19.

In a very simple alternative, an annular ram is periodically lifted by means of a cable attached thereto, which cable is actuated by a winch or other lifting means situated at the surface of the earth near the top of the borehole 1.

The invention is further not limited to the way in which the water is supplied to the cavity for feeding the jet nozzles 7 (FIG. 1), the jet nozzles 23 (FIG. 1), the jet pumps 9 (FIG. 1) and the hydraulic ram 30 (FIG. 3). If desired, a plurality of small diameter water supply pipes or tubes may be used for separately feeding the various equipment parts. The tubes or pipes may be displaced vertically independent of each other, and may be rotated in the borehole 1 simultaneously to allow the jets 6 and the jets 22 to act in the desired direction.

The production tubing and the liquid supply tubes may be arranged in one and the same borehole that forms a communication between the cavity and the surface. In an alternative arrangement, the cavity communicates with the surface through two or more boreholes, and the production tubing and the tube for supplying liquid to the jet pump are arranged in a borehole other than the borehole wherein the tube for supplying liquid to the jet nozzles is situated.

What we claim is:

1. A method for mining minerals from a subsurface deposit by locally jetting the deposit, collecting particles broken from the deposit in the lower part of a subsurface cavity that is being formed by the jetting, and transporting the particles to the surface while preventing any oversized particles from obstructing the transporting by intercepting and crushing said oversized particles before obstruction can occur.

2. The method according to claim 1, wherein the oversized particles are crushed by separate jetting action.

3. A method for cavity mining minerals from a subsurface deposit by hydraulically locally jetting the deposit, collecting the particles broken from the deposit in the lower part of a subsurface cavity that is being formed by the jetting action, crushing any oversized particles by operatively positioned crushing means to prevent clogging of the entrance to a pumping means by intercepting the oversized particles with the crushing means before the oversized particles can reach the pumping means, and pumping the particles to the surface.

4. A method for mining minerals from a subsurface deposit by locally jetting the deposit, collecting particles broken from the deposit in the lower part of a subsurface cavity that is being formed by the jetting, and transporting the particles to the surface while preventing any oversized particles from obstructing the transporting by crushing said oversized particles by action of a screw.

5. A method for mining minerals from a subsurface deposit by locally jetting the deposit, collecting particles broken from the deposit in the lower part of a subsurface cavity that is being formed by the jetting, and transporting the particles to the surface while preventing any oversized particles from obstructing the transporting by crushing said oversized particles by action of an impact hammer.

6. An apparatus for cavity mining minerals from a subsurface deposit comprising a first liquid supply tube carrying at least one liquid jet nozzle directed to the deposit, a second liquid supply tube carrying a jet pump connected to a production tubing, said jet pump having an entrance for particles to be transported to the surface and an outlet being connected to a production tubing leading to the surface, and means for crushing particles, said means being operatively positioned in a passage leading to and above the entrance of the jet pump.

7. Apparatus according to claim 6, wherein the cavity communicates with the surface through at least one borehole, and the production tubing and liquid supply tubes are arranged in this borehole.

8. Apparatus according to claim 6, wherein the means for crushing particles comprises at least one liquid jet nozzle connected to the second liquid supply tube and directed across the said entrance.

9. Apparatus according to claim 8, wherein the production tubing and the second liquid supply tube are concentrically arranged and the liquid jet nozzle directed across the said entrance is rotatable around the central axis thereof.

10. An apparatus for cavity mining minerals from a subsurface deposit comprising a first liquid supply tube carrying at least one liquid jet nozzle directly to the deposit, a second liquid supply tube carrying a jet pump connected to a production tubing, said jet pump having an entrance for particles to be transported to the surface and an outlet being connected to a production tubing leading to the surface, and means for crushing particles with a screw crusher, said means being operatively positioned in a passage leading to the entrance of the jet pump.

11. An apparatus according to claim 10, wherein one of the liquid supply tubes is rotatably arranged around the longitudinal axis thereof, and the screw crusher is carried on the outer wall of the said liquid supply tube.

12. An apparatus for cavity mining minerals from a subsurface deposit comprising a first liquid supply tube carrying at least one liquid jet nozzle directed to the deposit, a second liquid supply tube carrying a jet pump connected to a production tubing, said jet pump having an entrance for particles to be transported to the surface and an outlet being connected to a production tubing leading to the surface, and a means for crushing particles with an impact hammer, said means being operatively positioned in a passage leading to the entrance of the jet pump.

* * * * *